US010895083B1

(12) United States Patent
Potthoff et al.

(10) Patent No.: US 10,895,083 B1
(45) Date of Patent: Jan. 19, 2021

(54) DRYWALL LIFTING TOOL

(71) Applicants: Loren Jay Potthoff, Englewood, CO (US); Wanda Jean Potthoff, Englewood, CO (US)

(72) Inventors: Loren Jay Potthoff, Englewood, CO (US); Wanda Jean Potthoff, Englewood, CO (US)

( * ) Notice: Subject to any disclaimer, the term of this patent is extended or adjusted under 35 U.S.C. 154(b) by 0 days.

(21) Appl. No.: 16/748,094

(22) Filed: Jan. 21, 2020

(51) Int. Cl.
*E04G 21/16* (2006.01)

(52) U.S. Cl.
CPC ..... *E04G 21/167* (2013.01)

(58) Field of Classification Search
CPC ... E04F 21/18; E04F 21/1805; E04F 21/1811; E04F 21/1816; E04F 21/1822; E04F 21/1827; E04F 21/1833; E04F 21/1838; E04F 21/1844; E04F 21/185; E04F 21/1855; E04F 21/1861; E04F 21/1866; E04F 21/1872; E04F 21/1877; E04F 21/1883; E04F 21/1888; E04F 21/1894; E04G 21/16; E04G 2005/008
USPC ..... 414/11
See application file for complete search history.

(56) References Cited

U.S. PATENT DOCUMENTS 3,871,477 A * 3/1975 Kuest ..... E04F 21/1816 182/69.4
5,984,605 A * 11/1999 Young ..... E04F 21/1822 414/11
7,448,598 B1 * 11/2008 Elmlinger ..... B66D 1/28 254/338
8,287,221 B1 * 10/2012 Van Roekel ..... E04G 21/168 414/11
9,932,744 B2 * 4/2018 Vandenberg ..... E04F 21/22
10,590,663 B1 * 3/2020 Meeks ..... E04F 21/185
2002/0159863 A1 * 10/2002 Ray ..... E04F 21/18 414/11
2005/0098769 A1 * 5/2005 Raycraft ..... E04G 21/167 254/329

* cited by examiner

*Primary Examiner* — William V Gilbert

(57) ABSTRACT

The PB-DSR tool is a lightweight tool weighing approximately two pounds that construction workers who hang drywall (or plywood) can use to roll the heavy material from the ground to the workers on a scaffold instead of lifting it by himself using his back, arms and legs, which causes injuries. The worker on the ground stands the drywall or other material on end, leans it against the roller, and rolls it upwards to the person on the scaffold instead of lifting the drywall up to the worker on the scaffold.

Currently, a drywaller on the ground physically lifts a 100+ pound sheet of drywall, plywood or other heavy materials upwards as much as 20 feet to the person on the scaffold, who then has to lift and/or pull the materials up onto the scaffold. Both people must use their arms, knees, shoulders and back to lift the heavy material, and the worker on the scaffold sometimes uses his foot to slide the material up onto the scaffold. The PB-DSR helps eliminate this unsafe lifting procedure by providing a rolling mechanism to roll the sheet of material instead of lifting it. This takes most of the weight of the heavy material off the workers, making it safer and easier, and possibly reducing arm, shoulder, back and foot injuries from manually lifting the heavy sheet of drywall. It is an inexpensive way for drywall and construction companies to more likely than not reduce the number of workplace injuries and worker's compensation claims.

1 Claim, 10 Drawing Sheets

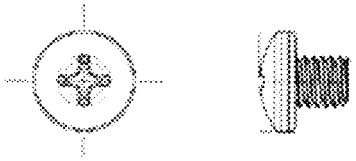
Fig. 8A
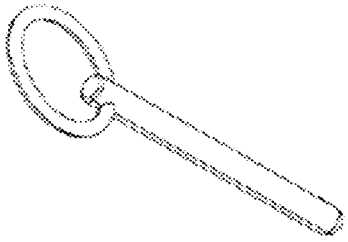
Fig. 8B
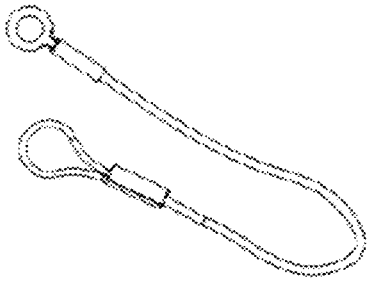
Fig. 8C
Fig. 8A, 8B and 8C

DRYWALL LIFTING TOOL

CROSS-REFERENCE TO RELATED APPLICATIONS

Provisional Application No. 62/761,372 filed Mar. 22, 2018 and Non-Provisional application Ser. No. 15/932,851.

STATEMENT REGARDING FEDERALLY SPONSORED RESEARCH OR DEVELOPMENT

Not applicable.

REFERENCE TO A "SEQUENCE LISTING"

None.

PATENT CITATIONS REFERENCED

Other items that could be used to accomplish the same thing are:

1. Elmlinger (U.S. Pat. No. 7,448,598) for lifting entire panels of walls from the ground into a standing position for installation;
2. Kuest (U.S. Pat. No. 3,871,477) which is a complex scaffold/lift combination that is a heavy tool requiring cranking to lift the material;
3. Raycraft (U.S. Publication 2005-0098769), which is similar to a ceiling mounted pulley system;
4. Ray (U.S. Publication 2002/0159863 A1) is a lifting platform that lifts multiple pieces of drywall, plywood or other materials using a pulley system to lift it up to the desired level where the material is being installed. Upper and lower clamps are used to clamp the platform to something (the publication is not clear on this). This appears to take some time to set up before using; and
5. Van Rockel (U.S. Pat. No. 8,287,221) that is a system for lifting entire walls that have been assembled horizontally on the ground and need to be lifted into a vertical position.
6. DSR Tool, patent application Ser. No. 15/932,851 is similar to the PB-DSR Tool except that it is designed to be used with the Safeway scaffolding, which has a round tubular frame.

Unlike the above patents, the PB-DSR Tool is a small, lightweight, portable tool that requires no set up, no assembly and no cranking or pulley to lift the materials. It is designed specifically for rolling heavy drywall, plywood and other materials from the ground up to a person on a scaffold instead of lifting it. You merely roll the material upward to a person on the scaffold.

BRIEF SUMMARY OF THE INVENTION

This invention was created by a man who has worked in the construction industry his entire adult life and spent many hours lifting 4'×8' or 4'×12' sheets of drywall weighing approximately 100 pounds or more from the ground up onto a scaffold, either by himself and/or with the help of others. He came up with the idea for a roller to slide the drywall to help get the drywall up to the workers on the scaffold by rolling it on the drywall scaffold roller, reducing the damage to his body, including his arms, legs, back and feet. He and an employee used the prototype several times on jobs to roll drywall up onto the scaffold.

The PB-DSR tool is a lightweight tool weighing approximately two pounds that construction workers who hang drywall (or plywood) can use to roll the heavy material from the ground to the workers on a scaffold instead of lifting it by himself using his back, arms and legs, which causes injuries. The worker on the ground stands the drywall or other material on end, leans it against the roller, and rolls it upwards to the person on the scaffold instead of lifting the drywall up to the worker on the scaffold.

This lift roller fits the Perry and Baker scaffolding with the square tubular framing.

BRIEF DESCRIPTION OF THE SEVERAL VIEWS OF THE DRAWINGS

Drawings are attached that include specifications and views of the various parts of the drywall scaffold roller as follows:

FIG. 8A is the Phillips pan head machine screw.
FIG. 8B is the ¼"×2½" quick release pin.
FIG. 8C is the 6" loop-to-loop lanyard.

DETAILED DESCRIPTION OF THE DRAWINGS

The PB-DSR Tool is a tool that every person who hangs drywall for a living needs for moving drywall from the ground onto a scaffold above the ground for installation on walls. It is lightweight, weighing approximately two pounds, mobile with no assembly or set up required and no cranking to lift the heavy material. This lift roller fits the Perry and Baker scaffolding with the square frames.

The body of the frame (FIG. 1) hooks onto the Perry and Baker scaffold frame.

Figure 2:
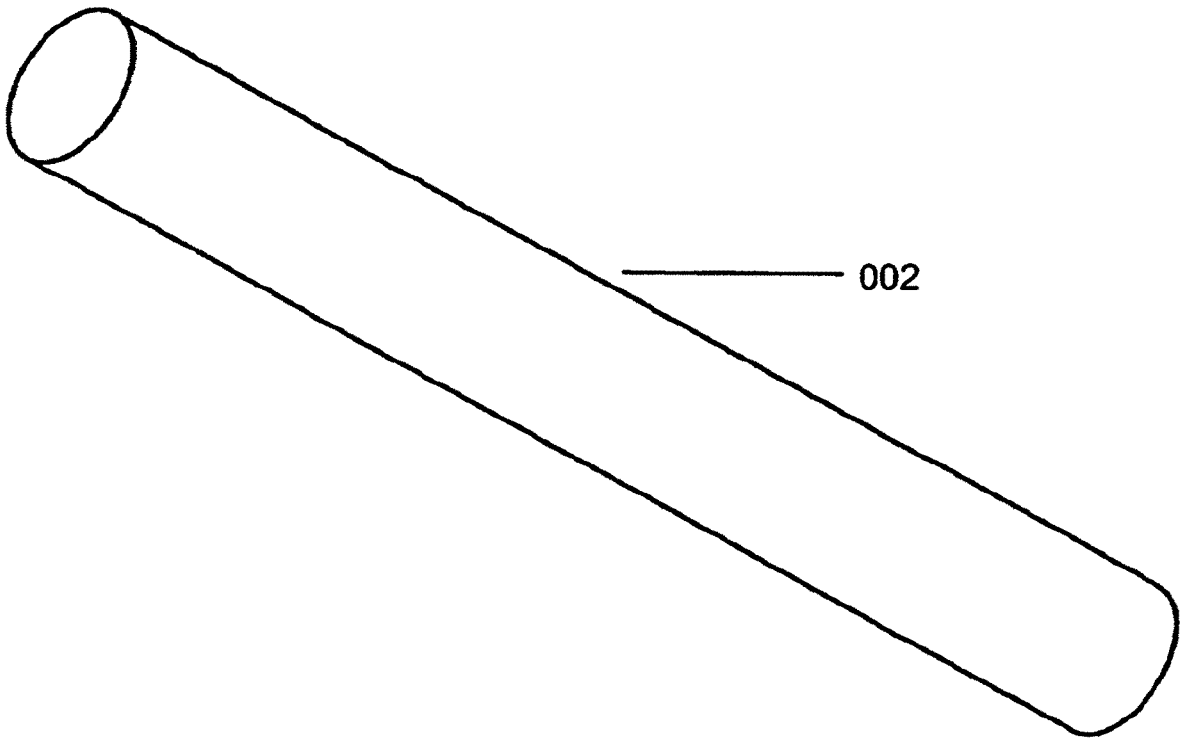
FIG. 2 is a half inch (0.500") metal rod.

A half inch (0.500) (FIG. 2) metal rod is inserted into the body of the frame (001-C) and welded to the back side of the frame.

A half inch (0.500) washer (FIG. 3) goes over the half inch rod (FIG. 2) and slides all the way to the back of the rod to the frame.

Figure 3:
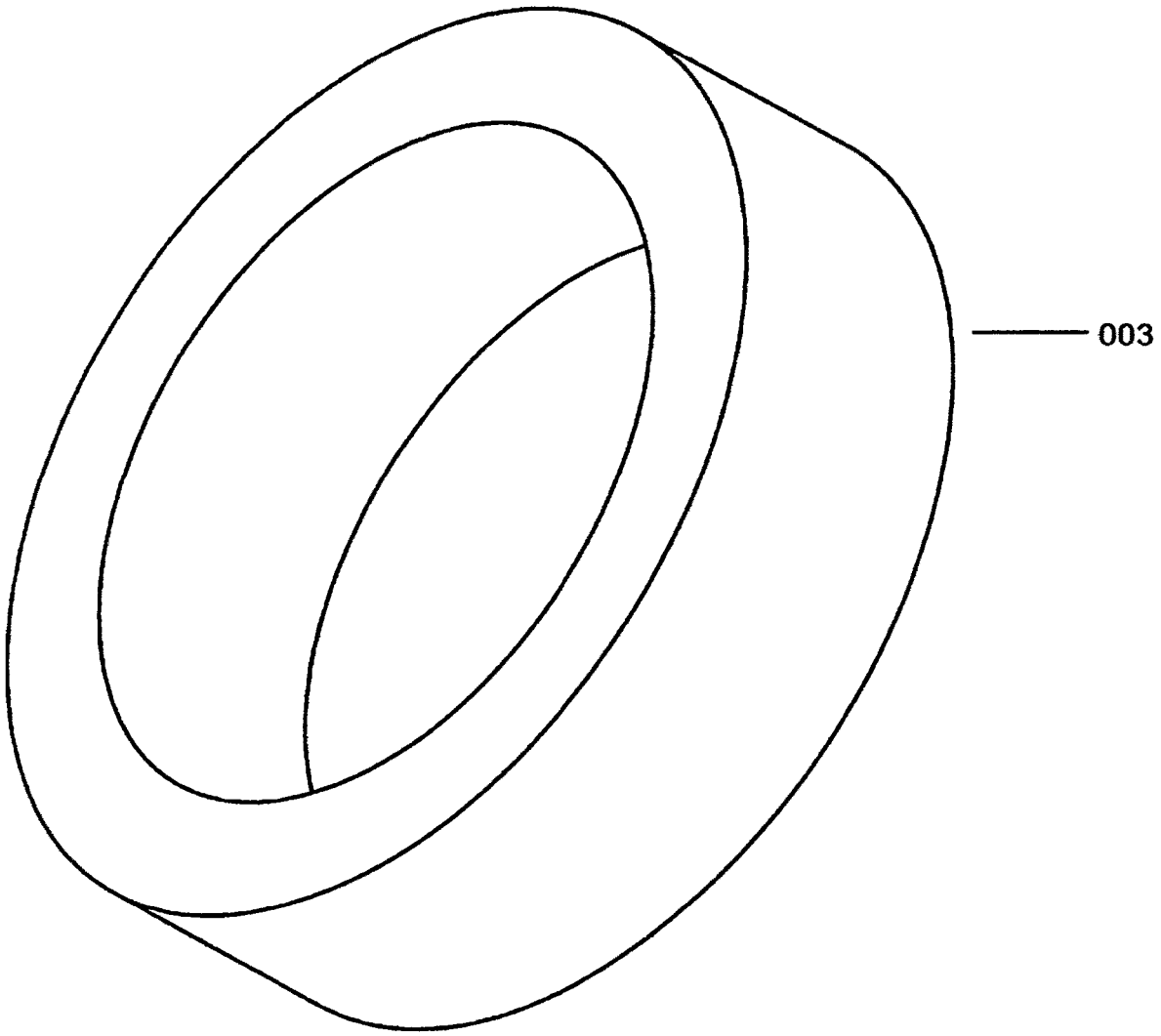
FIG. 3 is a half inch (0.500") nylon washer.

A roller (FIG. 4) slides over the half inch (0.500) rod (FIG. 2) to the washer (FIG. 3).

Figure 4:
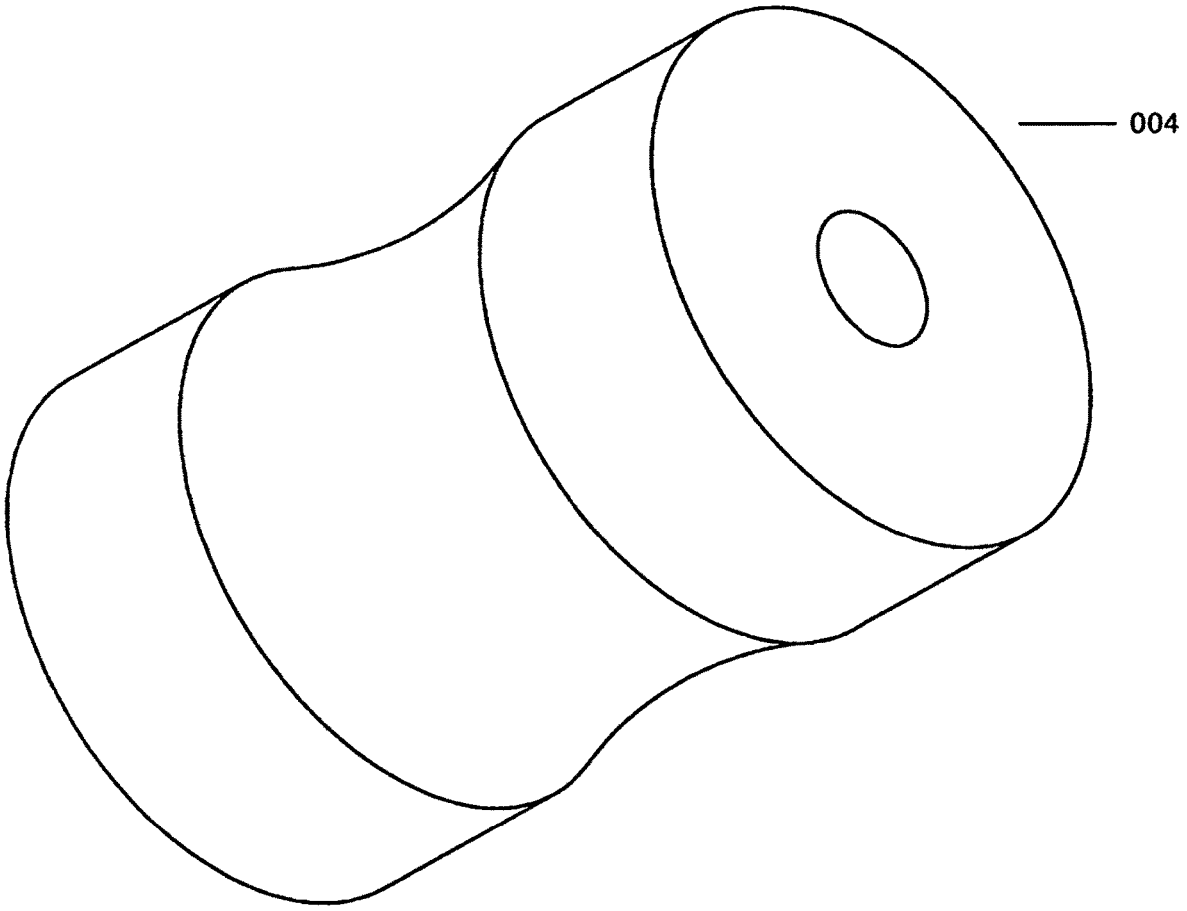
FIG. 4 is the UHMW 2" roller.

The 3/16" washer (FIG. 5) slides over the half inch (0.500) rod (FIG. 2) to the roller (FIG. 4).

Figure 5:
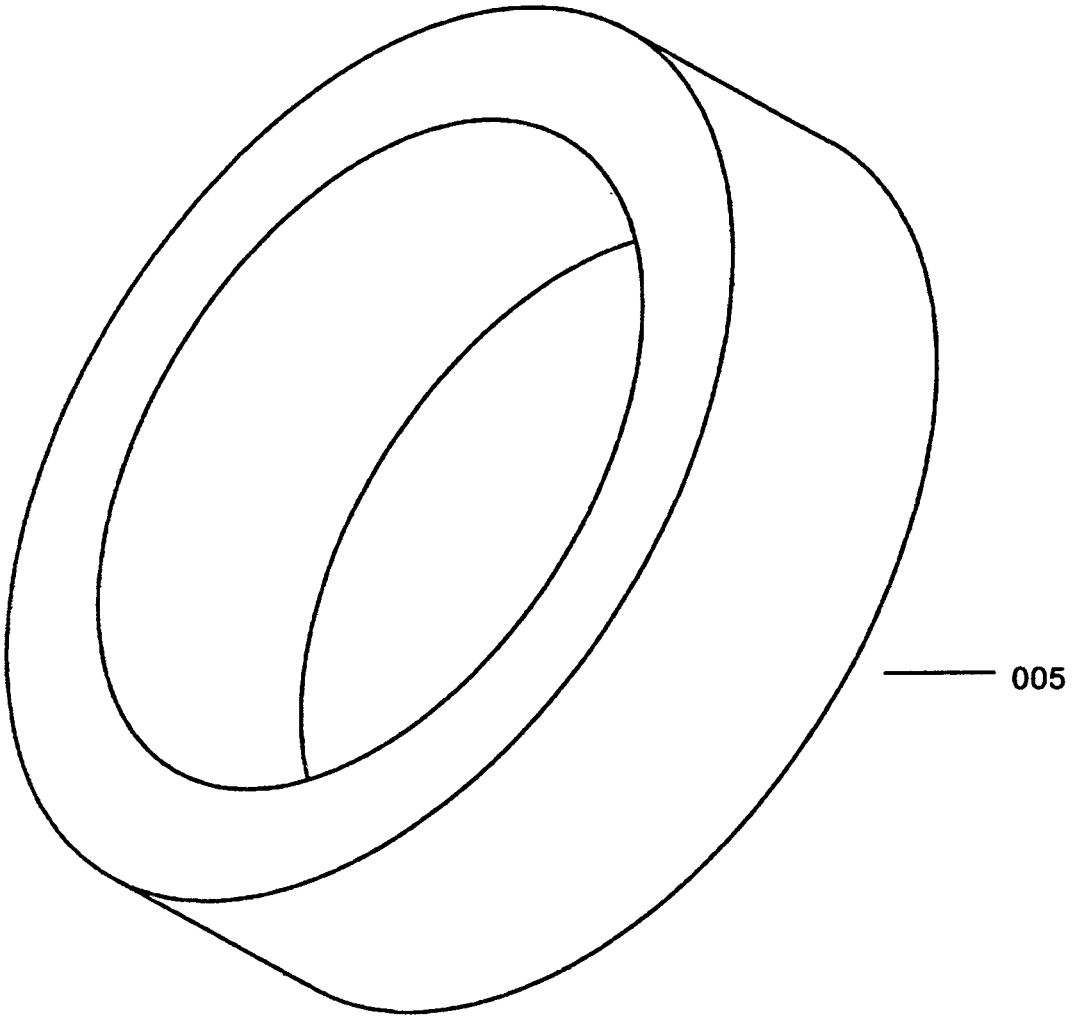
FIG. 5 is a 3/16" nylon washer/spacer.
Figure 6:
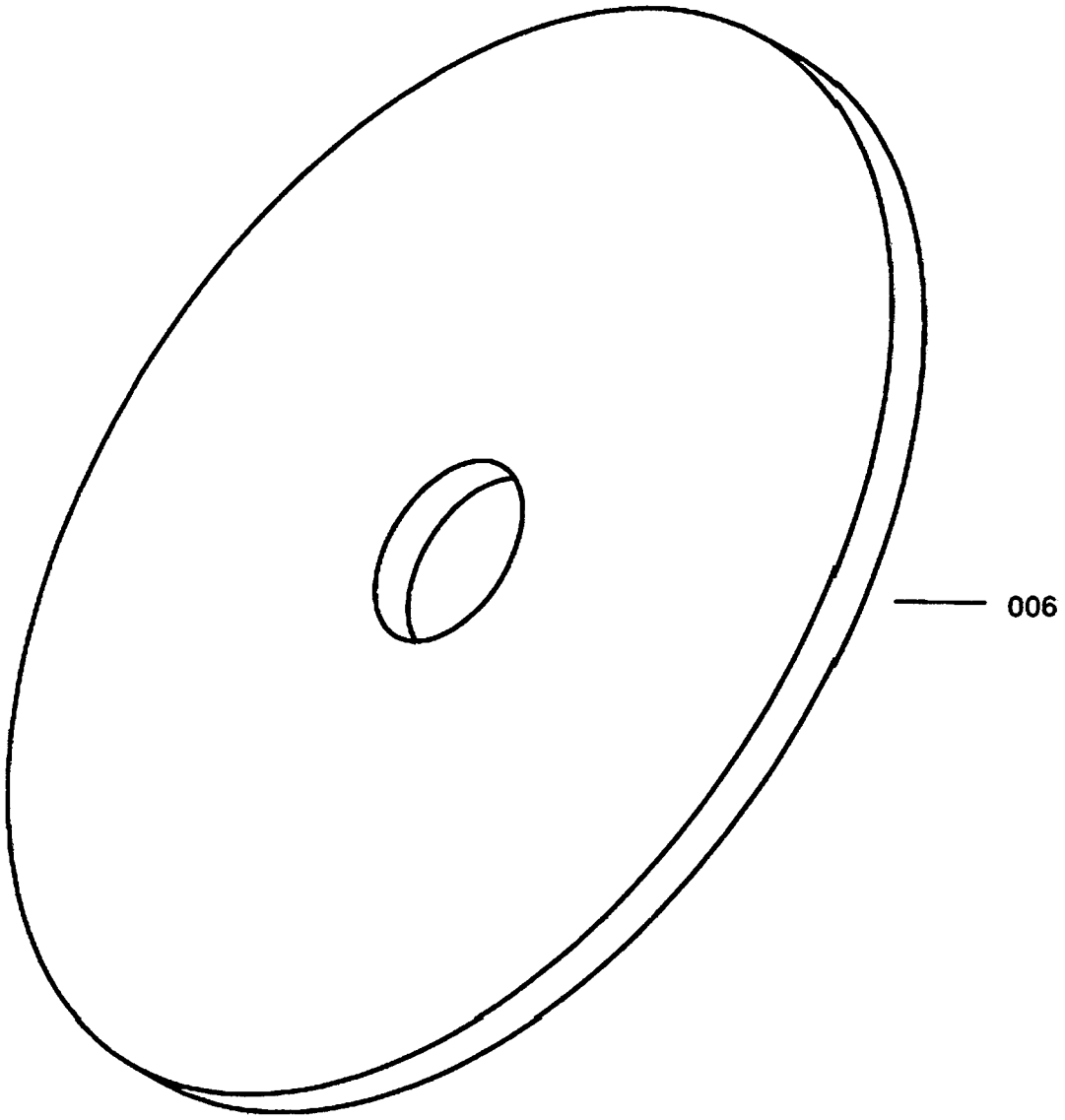
FIG. 6 is a 3" round metal 20 gauge disc.
Figure 7:
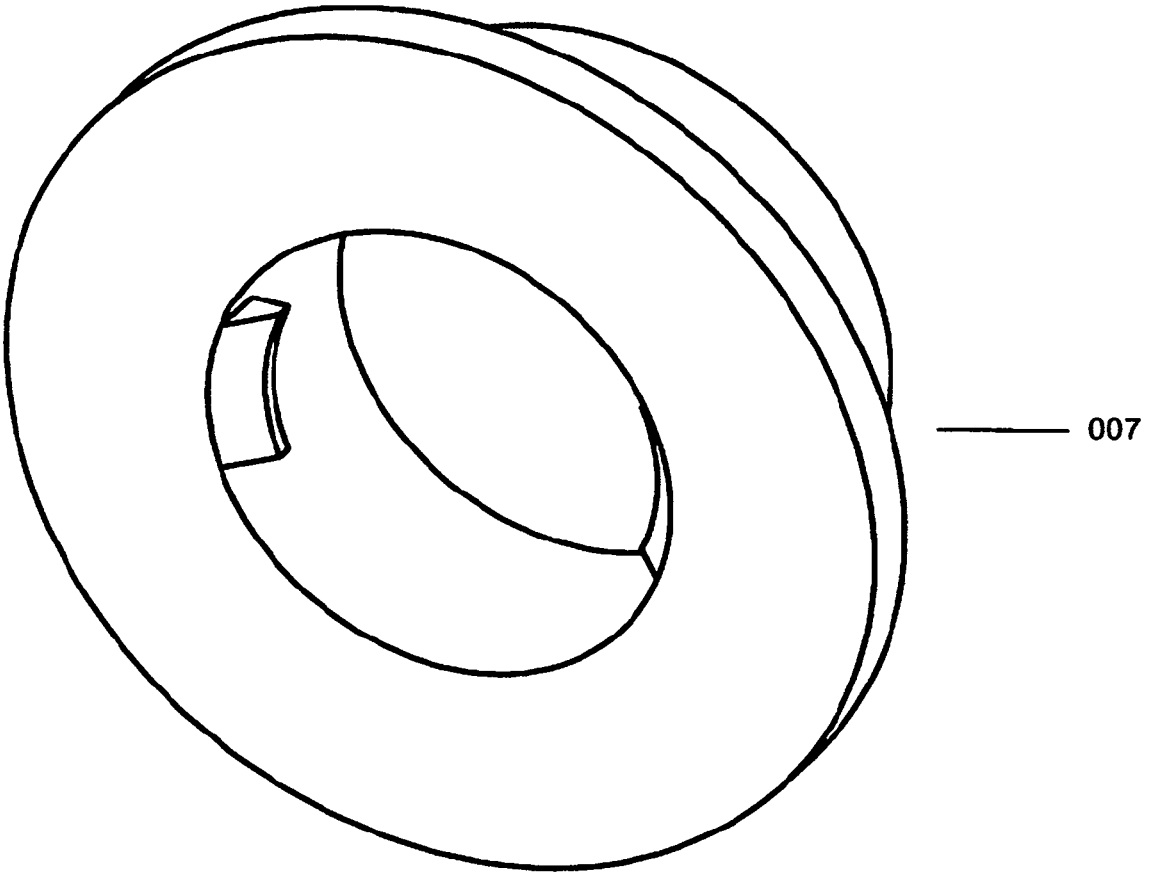
FIG. 7 is a metal cap.

The three inch round metal 14 gauge disc (FIG. 6) slides over the rod (FIG. 2) abutting to the 3/16" washer (FIG. 5).

The metal cap (FIG. 6) slides over the half inch (0.500) rod (FIG. 2) and is tapped into place so that it locks the rod (FIG. 2) to the roller (FIG. 4).

Figure 1:
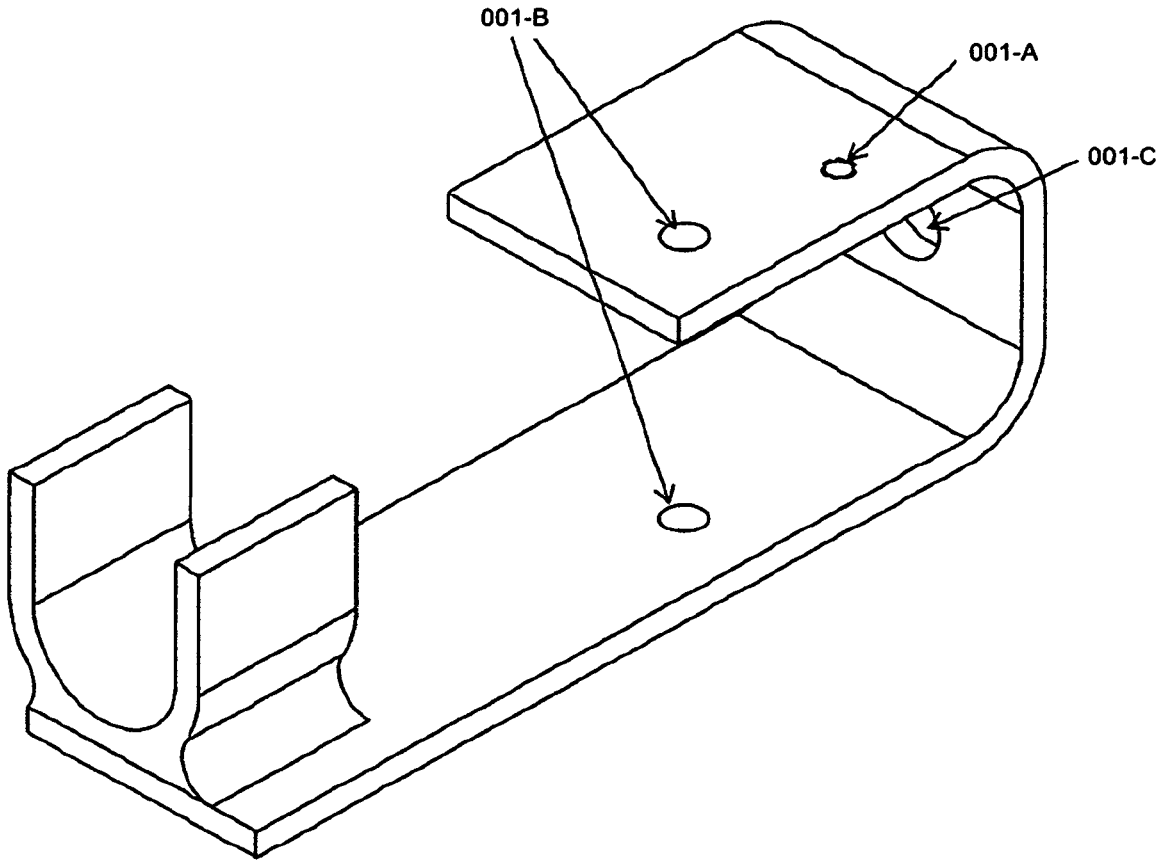
FIG. 1 is the main metal frame for the roller.

To secure the PB DSR Tool to the frame, the loop end of lanyard in (8-C) is attached to the ring at the top of the quick release ring (8-B) and inserted from front to back through the two holes depicted on FIG. 1 as 001-B. The eyelet of the lanyard is secured to the DSR Tool frame with the pan head machine screw (8-A) through the hole depicted on FIG. 1 as 001-A.

Figure 9:
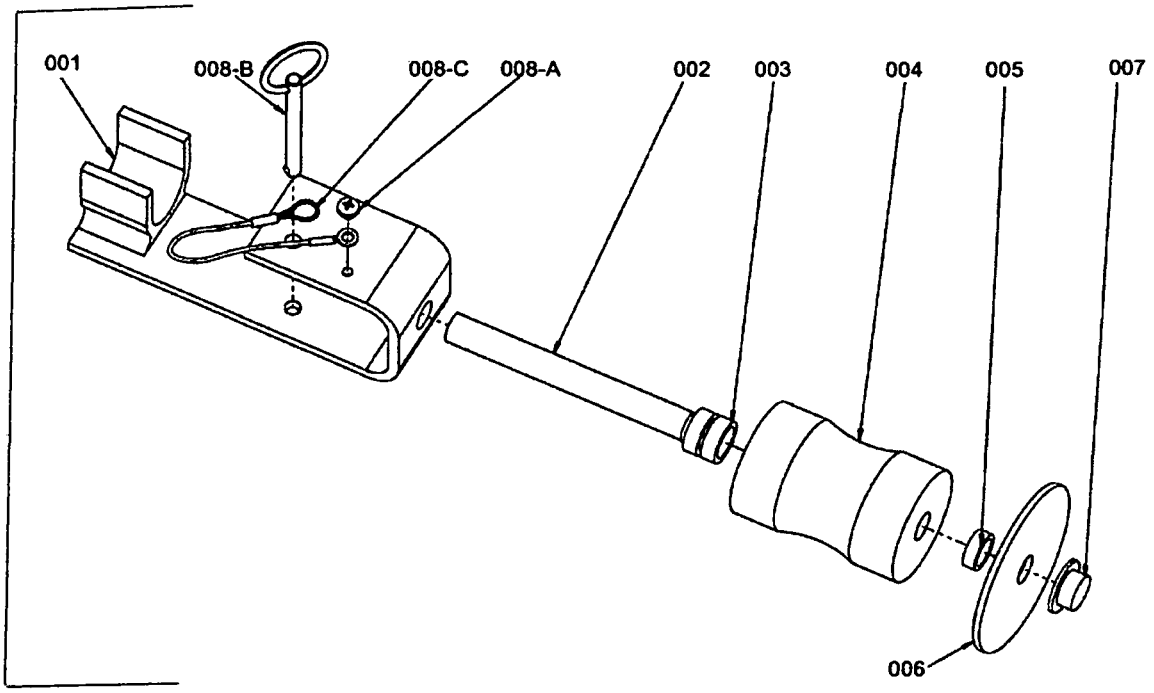
FIG. 9 is the assembly procedure for the PBDSR tool.

Assembly procedure is shown on (FIG. 9).

Figure 10:
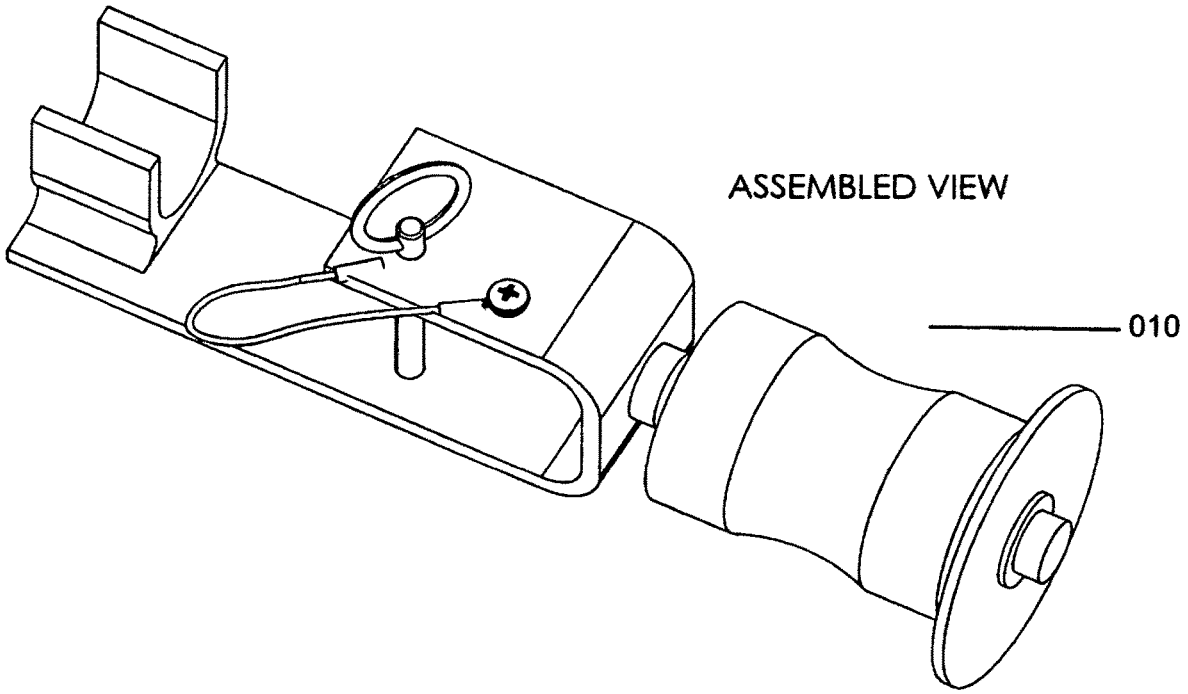
FIG. 10 is a view of the completely assembled PBDSR tool.

Assembled roller (FIG. 10).

The invention claimed is:

1. A tool for lifting drywall, comprising:

(a) a hanger flange, said hanger flange having a three-sided portion having a first side and a second side opposite said first side and a third side adjacent to and connecting a first end of the first side to a first end of the second side, a U-shaped member connected to a second end of said second side opposite said first end of said second side, with a first aperture and a second aperture each extending through a thickness of the first side of the flange, a first aperture extending through a thickness of the second side of the flange, and a first aperture extending through a thickness of the third side of said flange, said first aperture of said first side being aligned with said first aperture of said second side;

(b) a shaft having a first end and a second end, said first end extending into said aperture of said third side;

(c) a first spacer and a second spacer each having an aperture, said shaft extending through said aperture of said first spacer and said second spacer, said first spacer abutting said third side and said second spacer abutting said first spacer;

(d) a roller having a first end and a second end opposite said first end and an aperture extending from said first end to said second end of said roller, said shaft extending through said aperture of said roller, said first end of said roller abutting said second spacer;

(e) a third spacer having an aperture, said shaft extending through said aperture of said third spacer, said third spacer abutting said second end of said roller;

(f) a washer having an aperture, said shaft extending through said aperture of said washer, said washer abutting said third spacer;

(g) a push ring cup placed on said second end of said shaft;

(h) a quick release pin inserted through said first aperture of said first side and said first aperture of said second side;

(i) a loop-to-eye lanyard having a first end having a loop connecting to the quick release pin, and a second end of the lanyard having an eye connected to the first side of the flange by a panhead Phillips machine screw inserted through the eye of the lanyard and into the second aperture on the first side of the flange.

* * * * *